US007453412B2

(12) United States Patent
Murali et al.

(10) Patent No.: US 7,453,412 B2
(45) Date of Patent: Nov. 18, 2008

(54) NANOSTRUCTURED, MAGNETIC TUNABLE ANTENNAS FOR COMMUNICATION DEVICES

(75) Inventors: Kota V R M Murali, Bangalore (IN); Steven J. Franson, Scottsdale, AZ (US)

(73) Assignee: Motorola, Inc., Schaumburg, IL (US)

( * ) Notice: Subject to any disclaimer, the term of this patent is extended or adjusted under 35 U.S.C. 154(b) by 128 days.

(21) Appl. No.: 11/690,965

(22) Filed: Mar. 26, 2007

(65) Prior Publication Data

US 2008/0238779 A1 Oct. 2, 2008

(51) Int. Cl.
*H01Q 1/00* (2006.01)

(52) U.S. Cl. ..... 343/787; 343/700 MS; 343/850

(58) Field of Classification Search ..... 343/787, 343/700 MS, 850; 324/522, 66; 455/82, 455/83

See application file for complete search history.

(56) References Cited

U.S. PATENT DOCUMENTS

| | | | | |
|---|---|---|---|---|
| 5,170,493 | A * | 12/1992 | Roth | 455/82 |
| 6,660,388 | B2 | 12/2003 | Liu et al. | |
| 6,919,841 | B2 * | 7/2005 | Yamazaki | 342/357.06 |
| 7,224,170 | B2 * | 5/2007 | Graham et al. | 324/522 |
| 2001/0055529 | A1 | 12/2001 | Wixforth | |
| 2003/0214588 | A1 | 11/2003 | Takizawa et al. | |

FOREIGN PATENT DOCUMENTS

EP 1712531 A2 10/2006

OTHER PUBLICATIONS

Wixforth, Achim, Acoustically driven planar microfluidics, Superlattices and Microstructures 33 (2003) 389-396.

Takeuchi, M., et al., Ultrasonic Micromanipulation of Liquid Droplets for a Lab-on-a-Chip, 2005 IEEE Ultrasonic Symposium, pp. 1518-1521.

Chen, Xi, et al., Surface Liquid Droplet Motion on Silicon Ultrasonic Horn Actuators, 2005 IEEE Ultrasonic Symposium pp. 1032-1035.

Kwon, J.W., et al., Directional droplet ejection by nozzleless acoustic ejectors built on ZnO and PZT, Institute of Physic Publishing, Journal of Micromechanics and Microengineering 2006, pp. 2697-2704.

Tulapunkar, A.A., et al., Subnanosecond magnetization reversal in magnetic nanopillars by spin angular momentum transfer, Applied Physics Letters, vol. 85, No. 22, Nov. 29, 2004.

Tulapunkar, A.A., et al., Spin-torque diode effect in magnetic tunnel junctions, Nature, vol. 438, Nov. 2005.

(Continued)

*Primary Examiner*—Hoang V Nguyen

(57) ABSTRACT

A communication device (310) is provided that includes a nano-sized RF antenna (100) having low power consumption and wide-range frequency spectrum based on bottom-up nanotechnology. The antenna (100) includes an insulator layer (110) positioned between a free magnetic layer (112) and a fixed magnetic layer (108). A DC voltage source (124) is coupled to the free magnetic layer (112) and the fixed magnetic layer (108) for providing a current (118) therethrough. A detector (126) is coupled between the antenna (100) and the DC voltage source (124) for detecting a change in the current (118) in response to a radiated signal being received by the antenna (100) which causes a change in the spin on electrons in the free magnetic layer (112).

18 Claims, 4 Drawing Sheets

OTHER PUBLICATIONS

Krivorotov, K., et al., Time-Domain Measurements of Nanomagnet Dynamics Driven by Spin-Transfer Torques, Science, 307, 225 (2005).

Sankey, J.C., et al., Spin-Transfer-Driven Ferromagnetic Resonance of Individual Nanomagnets, Physical Review Letters, 96, 217601 (2006).

* cited by examiner

NANOSTRUCTURED, MAGNETIC TUNABLE ANTENNAS FOR COMMUNICATION DEVICES

FIELD OF THE INVENTION

The present invention generally relates to radiation elements (sensors) for antennas and phased arrays and more particularly to a macro-sized, magnetic RF antenna for mobile devices.

BACKGROUND OF THE INVENTION

Global telecommunication systems, such as cell phones and two way radios, are migrating to higher frequencies and data rates due to increased consumer demand on usage and the desire for more content. Current mobile devices are challenged by the increased functionality and complexity of multi-modes, multi-bands, and multi-standards, and progressing beyond 3 G with the increasing requirement of multimedia, mobile internet, connected home solutions, sensor-network, high-speed data connectivity such as Bluetooth, RFID, WLAN, WiMAX, UWB, and 4 G. Limited battery power and tight design space will become bottlenecks for the high integration and development of mobile devices. The tight design space is especially challenging for RF technologies and the requisite design/fabrication of adaptive/tunable antennas and antenna arrays. Nanosized RF antennas with low power consumption will be necessary.

Known antennas ranging from macro-size to micro-size, are based on a top-down approach, and are bulky. They have difficulties in meeting performance and power-consumption requirements, particularly with increased frequency, functionality and complexity of multi-modes, multi-bands, and multi standards for seamless mobility. Size and frequency limitation such as the Terahertz gap have been reached. With the increase of high frequency for high data rate communications, skin effect becomes more of an issue and causes the loss of efficiency for these conventional solid and bulky antennas, thereby impacting power consumption.

Accordingly, it is desirable to provide a macro-sized RF antenna for mobile devices having low power consumption and wide-range frequency spectrum based on bottom-up nanotechnology. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A communication device includes a macro-sized RF antenna having low power consumption and wide-range frequency spectrum based on bottom-up nanotechnology. The communication device includes receiver circuitry coupled to a controller. An antenna coupled to the receiver circuitry comprises a magnetic element including a plurality of electrons having a spin. A voltage source provides a DC current through the magnetic element. A detector measures changes in the DC current caused by reception of an RF signal that changes the spin on the plurality of electrons.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

Figure 1:
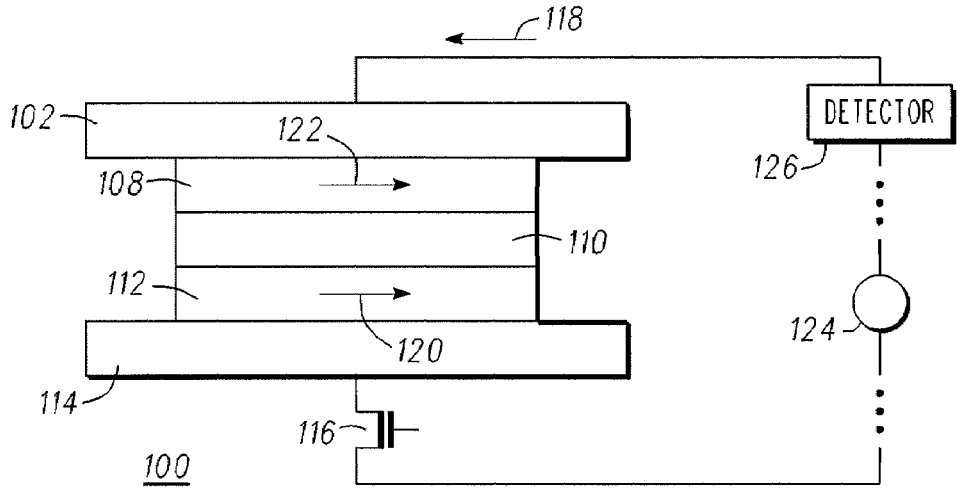
FIG. 1 is a partial cross-sectional view of a first exemplary embodiment.

The following detailed description of the invention is merely exemplary in nature and is not intended to limit the invention or the application and uses of the invention. Furthermore, there is no intention to be bound by any theory presented in the preceding background of the invention or the following detailed description of the invention.

An antenna system incorporating a magnetic nanostructure similar to those used in magnetic random access memories (MRAM) can perform in the broad wireless frequency spectrum from microwave such as 3 G/WCDMA, to millimeter wave, and to terahertz and beyond. The detection of RF signals is based on tuning of the spin resonance of a free ferromagnetic layer of a nanostructured MRAM device. The free ferromagnetic layer's magnetization is modulated by the incoming RF signal and is characterized by a proportionate modulation of a DC current through the device. The initial sensing of an RF signal that resonates with the spin resonance frequency causes the free layer magnetization to rotate, at least partially. This results in the modulation of the magnetic dipoles in the free magnetic layer of the MRAM device, resulting in a detectable modulation of the device current. The rate of change in the direction of the magnetization vector depends on the energy of the incoming RF signal.

Moreover, a nanostructure array of these devices provides a mechanism to detect individual frequencies in a wide frequency spectrum of RF signals by coupling a broadband antenna. This allows a high degree of tunability and specificity for which the individual MRAM devices are biased.

Generally, a single MRAM cell includes an upper ferromagnetic layer, a lower ferromagnetic layer, and a non-magnetic or insulating spacer between the two ferromagnetic layers. The upper ferromagnetic layer is the fixed magnetic layer because the direction of its magnetization is fixed. The lower ferromagnetic layer is the free magnetic layer because the direction of its magnetization can be switched to change the bit status of the cell. When the magnetization in the upper ferromagnetic layer is parallel to the magnetization in the lower ferromagnetic layer, the resistance across the cell is relatively low. When the magnetization in the upper ferromagnetic layer is anti-parallel to the magnetization in the lower ferromagnetic layer, the resistance across the cell is relatively high. The data ("0" or "1") in a given cell is read by measuring the resistance of the cell. In this regard, electrical conductors attached to the cells are utilized to read the MRAM data.

The orientation of magnetization in the free magnetic layer can point in one of two opposite directions, while the orientation of the fixed magnetic layer is fixed along one direction.

In conventional MRAM, the orientation of the magnetization in the free magnetic layer rotates in response to current flowing in a digit line and in response to current flowing in a write line. Selecting the directions of the currents will cause the magnetization in the free magnetic layer to switch from parallel to anti-parallel to the magnetization in the fixed magnetic layer. In a typical MRAM, the orientation of the bit is switched by reversing the polarity of the current in the write line while keeping a constant polarity of the current in the digit line.

Transmission mode spin-transfer switching is one technique for sensing an incoming signal. Writing bits using the spin-transfer interaction can be desirable because bits with a large coercivity (Hc) in terms of magnetic field induced switching (close to 1000 Oersteds (Oe)) can be switched using only a modest current, e.g., less than 5 mA. The higher He results in greater thermal stability and less possibility for disturbs. A conventional transmission mode spin-transfer switching technique for an MRAM cell includes a first magnetic layer, a nonmagnetic tunnel barrier layer, and a second magnetic layer. In this technique, the write current actually flows through the tunnel junction in the cell. According to the spin-transfer effect, the electrons in the write current become spin-polarized after they pass through the fixed magnetic layer. In this regard, the fixed layer functions as a polarizer. The spin-polarized electrons cross the nonmagnetic layer and, through conservation of angular momentum, impart a torque on the free magnetic layer. This torque causes the orientation of magnetization in the free magnetic layer to be parallel to the orientation of magnetization in the fixed magnetic layer. The parallel magnetizations will remain stable until a write current of opposite direction switches the orientation of magnetization in the free magnetic layer to be anti-parallel to the orientation of magnetization in the fixed magnetic layer.

The transmission mode spin-transfer switching technique requires relatively low power (compared to the conventional switching technique), virtually eliminates the problem of bit disturbs, results in improved data retention, and is desirable for small scale applications.

The spin-transfer effect is known to those skilled in the art for use in MRAM devices (See for example, U.S. Patent Publication No. 2006/0087880 which discloses an MRAM being written using spin-transfer reflection mode techniques; U.S. Pat. No. 6,967,863; and WIPO publication WO 2005/082061). Briefly, a current becomes spin-polarized after the electrons pass through the first magnetic layer in a magnet/non-magnet/magnet trilayer structure, where the first magnetic layer is substantially thicker than the second magnetic layer. The spin-polarized electrons cross the nonmagnetic spacer and then, through conservation of angular momentum, place a torque on the second magnetic layer, which switches the magnetic orientation of the second layer to be parallel to the magnetic orientation of the first layer. If a current of the opposite polarity is applied, the electrons instead pass first through the second magnetic layer. After crossing the nonmagnetic spacer, a torque is applied to the first magnetic layer. However, due to its larger thickness, the first magnetic layer does not switch. Simultaneously, a fraction of the electrons will then reflect off the first magnetic layer and travel back across the nonmagnetic spacer before interacting with the second magnetic layer. In this case, the spin-transfer torque acts so as to switch the magnetic orientation of the second layer to be anti-parallel to the magnetic orientation of the first layer. Spin-transfer as described so far involves transmission of the current across all layers in the structure. Another possibility is spin-transfer reflection mode switching. In reflection mode, the current again becomes spin-polarized as the electrons pass through the first magnetic layer. The electrons then cross the nonmagnetic spacer layer, but instead of also crossing the second magnetic layer, the electrons follow a lower resistance path through an additional conductor leading away from the interface between the nonmagnetic spacer and the second magnetic layer. In the process, some fraction of the electrons will reflect off this interface and thereby exert a spin-transfer torque on the second magnetic layer to align it parallel to the first magnetic layer.

Referring to FIG. 1, a side sectional view of a magnetic layer cell, or antenna cell 100, is configured in accordance with an exemplary embodiment. In practice, an architecture or device will include many cells 100, typically connected together in a matrix of columns and rows. The cell 100 is fabricated using known lithographic techniques. The fabrication of integrated circuits, microelectronic devices, micro electro mechanical devices, microfluidic devices, and photonic devices, involves the creation of several layers of materials that interact in some fashion. One or more of these layers may be patterned so various regions of the layer have different electrical or other characteristics, which may be interconnected within the layer or to other layers to create electrical components and circuits. These regions may be created by selectively introducing or removing various materials. The patterns that define such regions are often created by lithographic processes. For example, a layer of photoresist material is applied onto a layer overlying a wafer substrate. A photomask (containing clear and opaque areas) is used to selectively expose this photoresist material by a form of radiation, such as ultraviolet light, electrons, or x-rays. Either the photoresist material exposed to the radiation, or that not exposed to the radiation, is removed by the application of a developer. An etch may then be applied to the layer not protected by the remaining resist, and when the resist is removed, the layer overlying the substrate is patterned. Alternatively, an additive process could also be used, e.g., building a structure using the photoresist as a template.

The antenna cell 100 generally includes the following elements: a first conductor 102; a fixed magnetic element 108; a nonmagnetic spacer or insulator 110; a free magnet element 112; a second conductor 114; and an optional select transistor 116. In some exemplary embodiments, the fixed magnet element 108 may include (not shown) a fixed magnetic layer, a spacer layer, a pinned magnetic layer, and an antiferromagnetic pinning layer. The select transistor 116 is addressed when it is desired to sense the cell 100 by providing a current 118 from voltage source 124 therethrough from the first conductor 102 to the select transistor 116. In one embodiment, a plurality of similar MRAM cells 100 (e.g., a column of cells) may be coupled between a common first conductor 102 and a common second conductor 114 wherein only one of the transistors 116 would be utilized. The ellipses in the conductors on either side of the voltage source 124 indicate that the voltage source 124 may be coupled to a plurality of cells 100.

First conductor 102 is formed from any suitable material capable of conducting electricity. For example, first conductor 102 may be formed from at least one of the elements Al, Cu, Au, Ag, or their combinations.

The free magnetic element 112 is formed from a magnetic material having a variable magnetization. For example, free magnetic element 112 may be formed from at least one of the elements Ni, Fe, Mn, Co, or their alloys as well as so-called half-metallic ferromagnets such as NiMnSb, PtMnSb, $Fe_3O_4$, or $CrO_2$. As with conventional MRAM devices, the direction of the variable magnetization of free magnetic element 112 determines whether MRAM cell 100 represents a "1" bit or a "0" bit. In practice, the direction of the magnetization of free magnetic element 112 is either parallel or anti-parallel to the direction of the magnetization of fixed magnet element 108.

Free magnetic element 112 has a magnetic easy axis that defines a natural or "default" orientation of its magnetization. When the cell 100 is in a steady state condition with no current 118 applied, the magnetization of free magnetic element 112 will naturally point along its easy axis. As described in more detail below, the cell 100 is suitably configured to establish a particular easy axis direction for free magnetic element 112. From the perspective of FIG. 1, the easy axis of free magnetic element 112 points either to the right or to the left (for example, in the direction of the arrow 120). In practice, MRAM cell 100 utilizes anisotropy, such as shape or crystalline anisotropy, in free magnetic element 112 to achieve the orthogonal orientation of the respective easy axes.

In this exemplary embodiment, a nonmagnetic spacer or an insulator 110 is located between free magnetic element 112 and fixed magnet element 108. Spacer 110 is formed from any suitable material that can function as a non-magnetic conductor or an electrical insulator. For example, the non-magnetic conductor may be formed using materials like Cu or Al and the insulator 110 may be formed from a material such as oxides or nitrides of at least one of Al, Mg, Si, Hf, Sr, or Ti. For purposes of the cell 100, insulator 110 serves as a magnetic tunnel barrier element, and the combination of free magnetic element 112, insulator 110, and fixed magnet element 108 form a magnetic tunnel junction.

In the illustrated embodiment, fixed magnet element 108 has a magnetization that is either parallel or anti-parallel, e.g., arrow 122, to the magnetization of free magnetic element 112. In one practical embodiment, fixed magnet element 112 is realized as a pinned synthetic antiferromagnetic that may include (not shown) a fixed magnetic layer, a spacer layer, pinned magnetic layer, and an antiferromagnetic layer. As depicted in FIG. 1, the fixed magnetic layer 108 may be formed from any suitable magnetic material, such as at least one of the elements Ni, Fe, Mn, Co, or their alloys as well as so-called half-metallic ferromagnets such as NiMnSb, PtMnSb, $Fe_3O_4$, or $CrO_2$.

The optional select transistor 116 includes a first current electrode coupled to a voltage potential, a second current electrode coupled to the free magnetic layer 112 and a gate that, when selected, allows electrons to flow through the cell 100 to the first conductor 102.

In practice, the cell 100 may employ alternative and/or additional elements, and one or more of the elements depicted in FIG. 1 may be realized as a composite structure or combination of sub-elements. The specific arrangement of layers shown in FIG. 1 merely represents one suitable embodiment of the invention.

The other cells that share the first conductor 102 will not receive the current 118. Only the designated bit at the intersection of the first conductor 102 and the selected select transistor 116 will receive the current 118.

When an RF signal is received by the antenna cell 100, the RF signal strikes the free magnetic layer 112. Each antenna cell 100 has a characteristic resonance frequency that depends on the external magnetic field. The spins in the free magnetic layers precess at this resonance frequency, which is known as Larmor frequency. The energy corresponding to the resonance frequency is given by the equation $E=\mu_e \cdot B$, where $\mu_e$ is the magnetic moment of the electron and B is the external magnetic field. This external magnetic field that influences the spins in the free ferromagnetic layer is generated by a dc current line and the field generated by the fixed ferromagnetic layer. When the RF signal strikes the free magnetic layer 112, the electrons within start to undergo Bloch oscillations, giving rise to a modulation in the DC current 118 through the nanostructure. This change in DC current is detected by the detector 126 and would indicate the reception of the frequency of the RF signal. Hence the incoming RF signal is detected as a modulation in the DC current, thus providing a mechanism for RF detection in a simple and straightforward manner.

Figure 2:
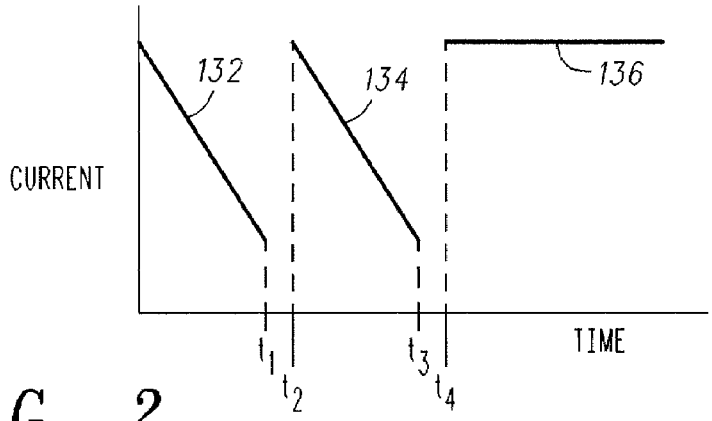
FIGS. 2 and 3 are graphs depicting the operation of the first exemplary embodiment.
Figure 3:
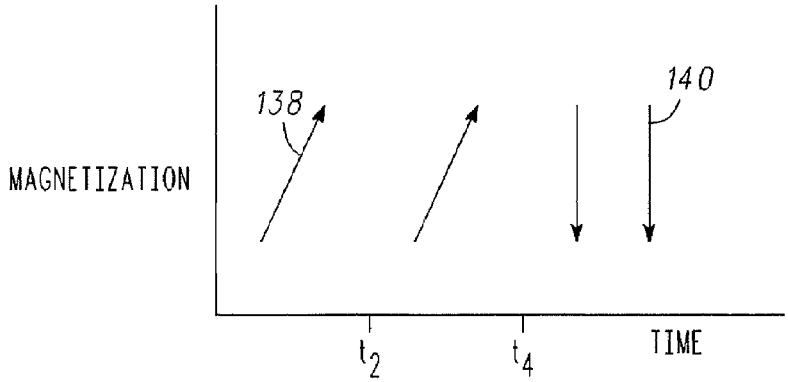

FIGS. 2 and FIG. 3 illustrate current 118 and magnetization 120, respectively, versus time. When an RF signal is received, the magnetization vector 138 is "flipped" from the initial orientation of the magnetization vector 140 when no RF signal is being received. When a carrier signal for a incoming RF signal is received, a change 132 in the current 118 occurs. After a predetermined period of time, $t_1$, that signifies a data bit, the magnetization is reset. After the zero reset, $t_2$, and if the carrier signal is still being received, another change 134 in the current 118 occurs. After another zero reset at t3, and if the RF signal discontinues, there will be no change 136 in the current 118 starting at $t_4$. These current changes in relation to the spin of electrons, or magnetization, within free magnetic layer 112 may be seen in FIG. 3. The magnetization vectors 138 shown in FIG. 3 are less than 180 degrees out of phase with the magnetization vectors 140. Basically, a zero reset is used to remove ambiguities arising due to variation in the incoming RF power. After the duration of every bit, the device is reset to its lowest resistance state, which is when the orientations of the two magnetic layers are parallel.

Figure 4:
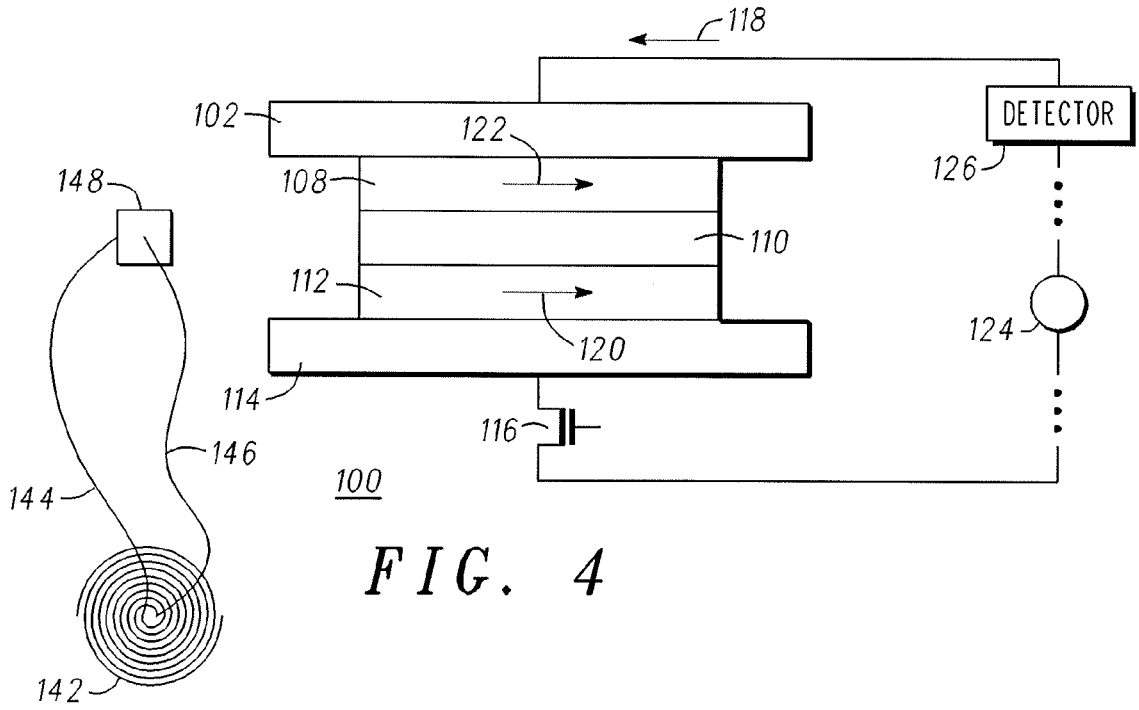
FIG. 4 is a partial cross-sectional view of a second exemplary embodiment.
Figure 5:
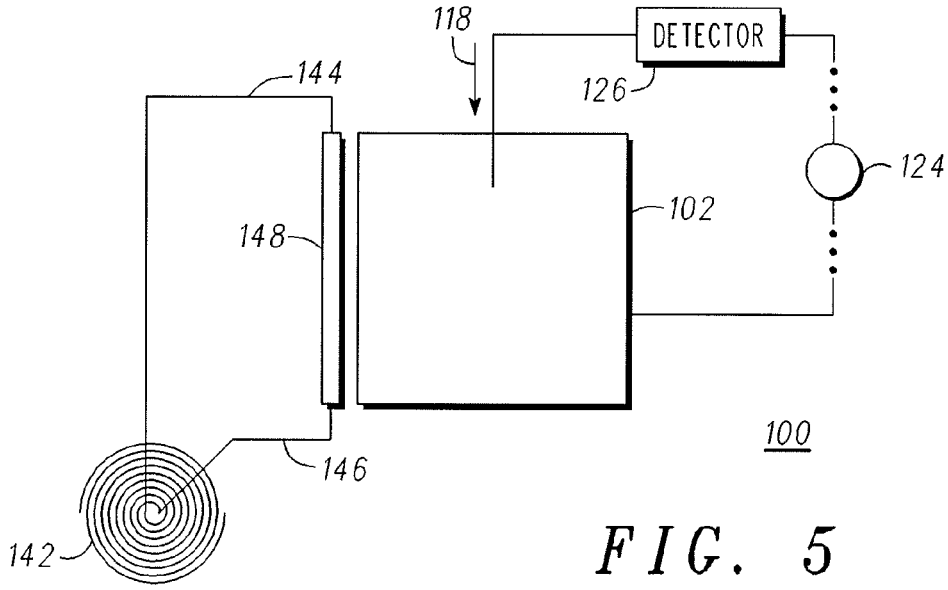
FIG. 5 is a partial top view of the second exemplary embodiment of FIG. 4

To improve the sensitivity of the antenna cell 100, a spiral antenna 142 is coupled by conductors 144, 146 (a side cross sectional view in FIG. 4 and a top view in FIG. 5) to a conductive line 148 formed adjacent the antenna cell 100. The spiral antenna 142, conductors 144, 146, and conductive line 148 may be integrated in an integrated circuit with the cells 100, or they may be external to the integrated circuit. The conductive line 148 may optionally simply comprise a wire adjacent to the cell. An RF signal striking the spiral antenna 142 is provided to the line 148, thereby providing a magnified signal. The spiral antenna 142 comprises the front end of a receiver and the cell 100 would be tunable to the required frequency that needs to be detected. Although the spiral antenna 142 is described with this exemplary embodiment, any type of antenna may be used with the antenna cell 100. A spiral antenna is just one example of a broadband antenna that may be used. When a plurality of antenna are used, each tuned to a different frequency, a broadband antenna would be required to cover all of the frequencies of the devices. Alternately, multiple antennas could be used, one for each device.

Figure 6:
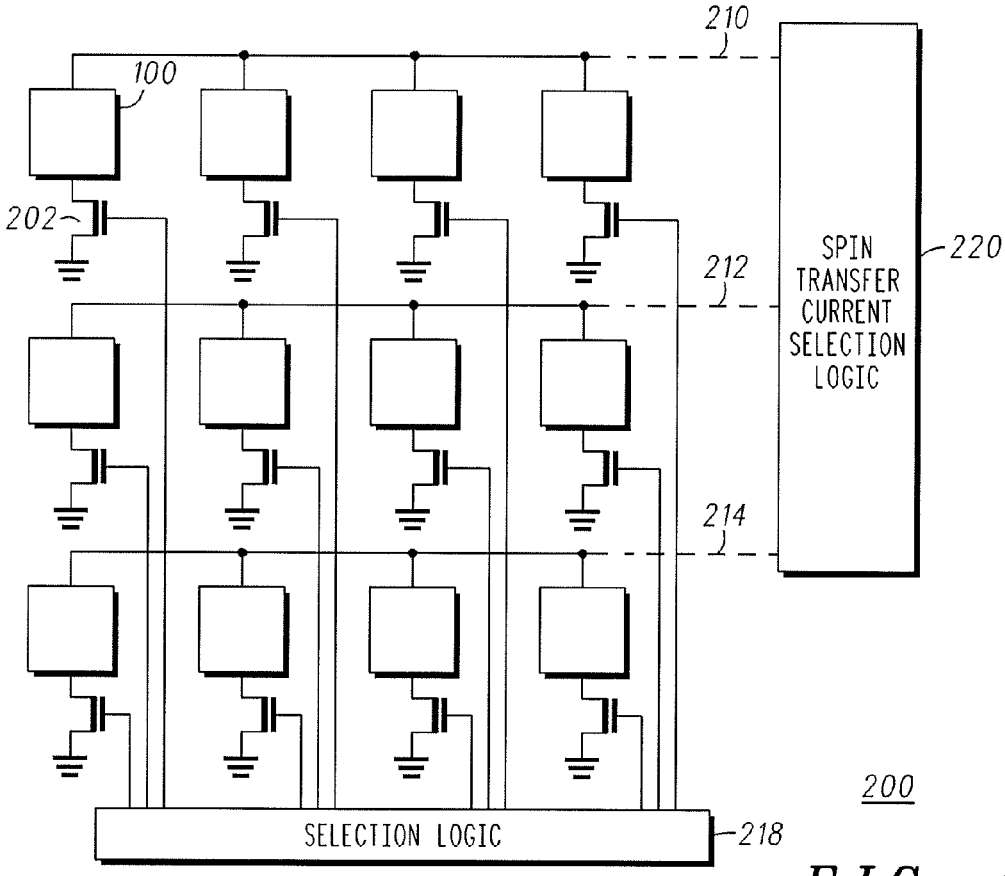
FIG. 6 is a partial block diagram of a third exemplary embodiment including either the first or second exemplary embodiment.

A practical architecture may include an array or matrix of the cells 100 having individual selectivity as described herein. FIG. 6 is a schematic representation of an example array 200 that may employ any number of the cells 100. The ellipses in FIG. 6 indicate that the MRAM array 200 can include any number of rows and any number of columns. In this example, each cell 100 is coupled to its own isolation transistor 202, and cells 100 in a given row share a common current line 210, 212, and 214. The array 200 includes logic 218 that controls the selection of isolation transistor 202, and logic 220 that in turn controls the selection and/or application of current to the appropriate write line 210, 212, 214.

As discussed above, the device can be tuned to the desired frequency by simply changing the external magnetic field. This field is controlled by the DC current through the bias line that is fabricated next to each individual nanostructure. The change in the current causes a change in the magnetic field which in turn tunes the resonance frequency of the electron spins in the free magnetic layer. The selectivity of the device is determined by the line width of the resonance, or absorption spectrum, of the spins. This provides the mechanism for high selectivity in the detection of the frequency of interest. Multi-frequency detection can be achieved using an array of the magnetic nanostructures, where each individual nanostructure can be turned to a particular frequency of interest, thereby leading to multi-frequency detection. Change in the orientation of the free magnetic layer of individual nanostructures results in a mismatch of orientation with respect to the fixed magnetic layer, hence leading to a change in the resistance of the device. This results in a change in the current through the nanostructure device that can be detected.

Figure 7:
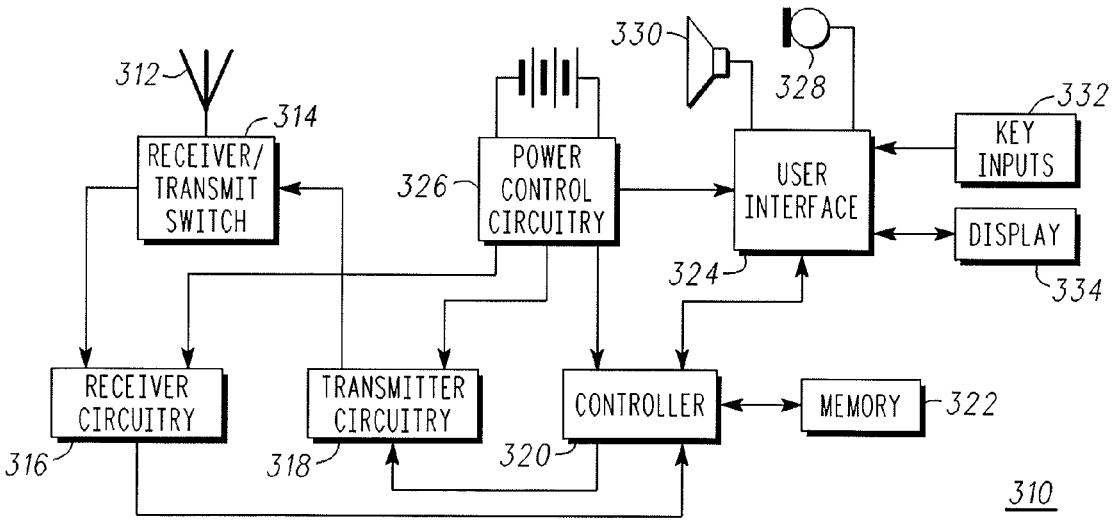
FIG. 7 is a block diagram of a portable communication device that may be used in accordance with an exemplary embodiment.

Referring to FIG. 7, a block diagram of a portable communication device 310 such as a cellular phone, in accordance with the preferred embodiment of the present invention is depicted. The portable electronic device 310 includes an antenna 312 for receiving and transmitting radio frequency (RF) signals, which may comprise any embodiments within the present invention, e.g., structures 100 and 200. A receive/transmit switch 314 selectively couples the antenna 312 to receiver circuitry 316 and transmitter circuitry 318 in a manner familiar to those skilled in the art. The receiver circuitry 316 demodulates and decodes the RF signals to derive information therefrom and is coupled to a controller 320 for providing the decoded information thereto for utilization thereby in accordance with the function(s) of the portable communication device 310. The controller 320 also provides information to the transmitter circuitry 318 for encoding and modulating information into RF signals for transmission from the antenna 312. As is well-known in the art, the controller 320 is typically coupled to a memory device 322 and a user interface 324 to perform the functions of the portable electronic device 310. Power control circuitry 326 is coupled to the components of the portable communication device 310, such as the controller 320, the receiver circuitry 316, the transmitter circuitry 318 and/or the user interface 324, to provide appropriate operational voltage and current to those components. The user interface 324 includes a microphone 328, a speaker 330 and one or more key inputs 332, including a keypad. The user interface 324 may also include a display 334 which could include touch screen inputs.

Figure 8:
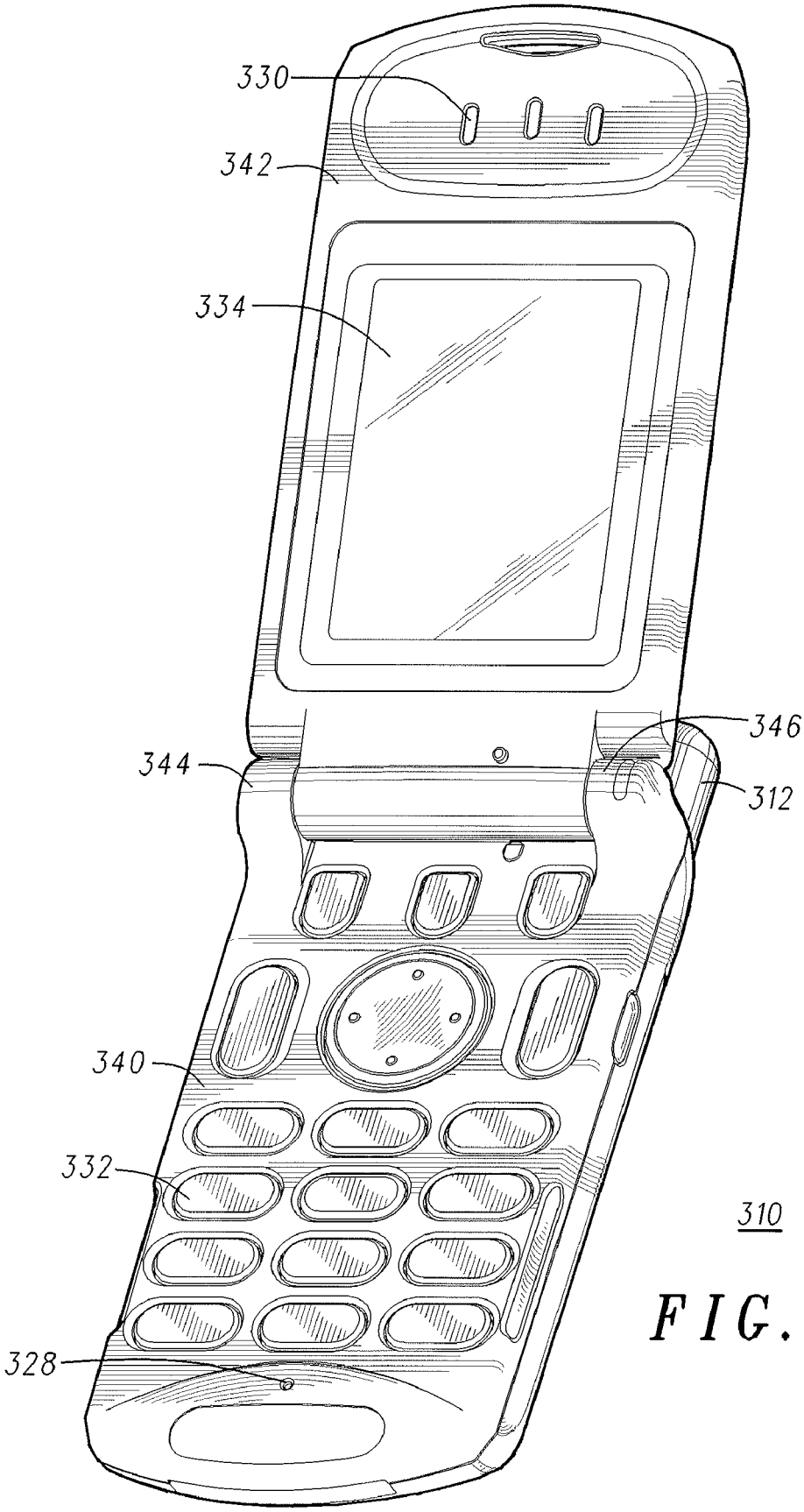
FIG. 8 is a diagram of portable communication device that may be used in accordance with an exemplary embodiment.

Referring to FIG. 8, the portable communication device 310 in accordance with the preferred embodiment of the present invention is depicted. The portable communication device 310 includes a housing which has a base portion 340 for enclosing base portion circuitry and an upper clamshell portion 342 for enclosing upper clamshell portion circuitry. The base portion 340 has the microphone 328 mounted therein and a plurality of keys 332 mounted thereon. The upper clamshell portion 342 has the speaker 330 and the display 334 mounted thereon. A plurality of hinges, such as hinge knuckles 344 and 346, rotatably couple the base portion 340 of the housing to the upper clamshell portion 342. The antenna 312 can be mounted either external or internal or inside the housing with a proper grounding in the portable device 310.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

The invention claimed is:

1. A communication device comprising:
- a radiated signal receiver; and
- a first antenna capable of receiving a first DC current and comprising:
  - a first free magnetic layer;
  - a first fixed magnetic layer;
  - a first insulator layer positioned between the first free magnetic layer and the first fixed magnetic layer; and
  - a first detector coupled to the first antenna for detecting a change in the first DC current in response to a radiated signal being received by the first antenna, and a first output coupled to the receiver.

2. The communication device of claim 1 further comprising a second antenna having a received signal conductor positioned adjacent to the free magnetic layer.

3. The communication device of claim 1 wherein the first antenna is tuned to a frequency in the range of microwave to terahertz.

4. The communication device of claim 1 wherein the detector detects a change in current caused by tuning of the spin resonance of the free magnetic layer.

5. The communication device of claim 1 wherein the first antenna senses a first frequency and further comprising a second antenna capable of receiving a second DC current and that senses a second frequency, the second antenna comprising:
- a second free magnetic layer;
- a second fixed magnetic layer;
- a second insulator layer positioned between the second free magnetic layer and the second fixed magnetic layer; and
- a second detector coupled to the second antenna for detecting a change in the second DC current in response to a radiated signal being received by the second antenna, and a second output coupled to the receiver.

6. The communication device of claim 5 further comprising a third antenna having a received signal conductor positioned adjacent to each of the first and second magnetic elements.

7. A communication device comprising:
- receiver circuitry;
- a controller coupled to the receiver circuitry; and
- a first antenna coupled to the receiver circuitry, the first antenna comprising:
  - a first magnetic element including a plurality of electrons having a spin, and capable of receiving a DC current; and
  - a first device for measuring changes in the DC current caused by reception of a first RF signal that changes the spin on the plurality of electrons.

8. The communication device of claim 7 further comprising a second antenna having a received signal conductor positioned adjacent to the magnetic element.

9. The communication device of claim 7 wherein the magnetic element comprises:
- a free magnetic layer including the plurality of electrons;
- a fixed magnetic layer; and
- an insulator layer positioned between the free magnetic layer and the fixed magnetic layer.

10. The communication device of claim 7 wherein the magnetic element includes electrons having a spin that is resonate to a specific frequency.

11. The communication device of claim 7 wherein the first antenna senses a first frequency and further comprising a second antenna that senses a second frequency, the second antenna comprising:

a second magnetic element including a plurality of electrons having a spin, and capable of receiving the DC current; and a second device for measuring changes in the DC current caused by reception of a second RF signal that changes the spin on the plurality of electrons.

12. The communication device of claim 11 further comprising a third antenna having a received signal conductor positioned adjacent to each of the first and second magnetic element.

13. The communication device of claim 11 wherein each of the first and second magnetic elements comprises:

a free magnetic layer including the plurality of electrons;

a fixed magnetic layer; and an insulator layer positioned between the free magnetic layer and the fixed magnetic layer.

14. A method for sensing an RF signal by a communication device, comprising:

supplying a DC current through a first antenna cell comprising a first insulating layer positioned between a first free magnetic layer and a first fixed magnetic layer;

exposing the first free magnetic layer of the first antenna cell to the RF signal, wherein a change in spin is imparted upon electrons in the first free magnetic layer; and detecting a change in the DC current caused by the spinning of the electrons changing a magnetization vector in the first free magnetic layer from a first direction to a second direction.

15. The method of claim 14 further comprising sensing the RF signal by a second antenna having a signal carrying conductor positioned adjacent to the free magnetic layer that that magnifies the RF signal to the first free magnetic layer.

16. The method of claim 14 further comprising periodically resetting the magnetic vector to its first direction.

17. The method of claim 14 wherein the RF signal comprises one of a first RF frequency and a second RF frequency, and wherein the spin imparted upon electrons in the first free magnetic layer is resonant with the first frequency when received, further comprising:

supplying the DC current through a second antenna cell comprising a second insulating layer positioned between a second free magnetic layer and a second fixed magnetic layer;

exposing the second free magnetic layer of the second antenna cell to the RF signal, wherein a change in spin is imparted upon electrons in the second free magnetic layer by the second RF frequency when received, wherein the spin imparted upon electrons in the second free magnetic layer is resonant with the second frequency; and detecting a change in the DC current caused by the spinning of the electrons changing a magnetization vector in the second free magnetic layer from a first direction to a second direction.

18. The method of claim 17 further comprising sensing the RF signal by a third antenna having a signal carrying conductor positioned adjacent to the first and second free magnetic layer that that magnifies the RF signal to the first and second free magnetic layers.

* * * * *